US005974769A

United States Patent [19]

Vetter

[11] Patent Number: 5,974,769

[45] **Date of Patent: *Nov. 2, 1999**

[54] AUTOMATED CONTAINER INSERT DEVICE

[75] Inventor: Kurt W. Vetter, Huntington, N.Y.

[73] Assignee: Uniflex, Inc., Westbury, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/904,669

[22] Filed: Aug. 1, 1997

[51] Int. Cl.[6] ..... B65B 9/06

[52] U.S. Cl. ..... 53/450; 53/553; 53/435; 53/520; 53/55

[58] Field of Search ..... 53/450, 550, 553, 53/435, 520, 568, 474, 238, 156, 157, 55, 244; 414/225, 752, 27; 269/21

[56] References Cited

U.S. PATENT DOCUMENTS

| | | | |
|---|---|---|---|
| 2,524,846 | 10/1950 | Socke et al. | 53/238 |
| 2,550,920 | 5/1951 | Gilbert | 53/53 |
| 2,705,857 | 4/1955 | Fox | 53/553 |
| 2,964,892 | 12/1960 | Grosjean | 53/386.1 |
| 3,020,687 | 2/1962 | Joa | 53/553 |
| 3,093,530 | 6/1963 | Lippman | 53/555 |
| 3,140,572 | 7/1964 | Petersen | 53/553 |
| 3,534,666 | 10/1970 | Maccherone | 493/194 |
| 3,561,187 | 2/1971 | Rohnert | 53/450 |
| 3,633,731 | 1/1972 | Jones | 414/27 |
| 3,735,551 | 5/1973 | Pratt | 53/553 |
| 4,182,222 | 1/1980 | Kotsiopoulos | 53/553 |
| 4,286,907 | 9/1981 | Houle et al. | 414/27 |
| 4,668,147 | 5/1987 | Sample et al. | 414/27 |
| 4,668,148 | 5/1987 | Sample et al. | 414/27 |
| 4,668,158 | 5/1987 | Sample et al. | 414/27 |
| 4,767,143 | 8/1988 | Michael et al. | 414/793 |
| 4,798,040 | 1/1989 | Haas | 53/460 |
| 4,850,781 | 7/1989 | DeBin et al. | 414/27 |
| 4,915,368 | 4/1990 | Tsunekawa | 270/58 |
| 4,923,436 | 5/1990 | Gelbard | 383/8 |
| 5,035,568 | 7/1991 | Joulin | 414/793 |
| 5,035,571 | 7/1991 | Raasch | 414/793 |
| 5,061,146 | 10/1991 | Nelson | 414/412 |
| 5,074,735 | 12/1991 | Stock | 414/27 |
| 5,079,901 | 1/1992 | Kotsiopoulos | 53/435 |
| 5,228,268 | 7/1993 | Jensen | 53/415 |
| 5,398,486 | 3/1995 | Kauss et al. | 53/436 |
| 5,456,570 | 10/1995 | Davis et al. | 414/742 |
| 5,561,962 | 10/1996 | Everhard | 53/55 |
| 5,588,280 | 12/1996 | Kotsiopoulos | 53/435 |
| 5,622,400 | 4/1997 | George | 294/64.1 |

*Primary Examiner*—Peter Vo
*Assistant Examiner*—James P. Calve
*Attorney, Agent, or Firm*—Dilworth & Barrese

[57] ABSTRACT

A turret assembly for use in a container manufacturing apparatus which comprises a rotatable hub, at least one arm extending radially from the rotatable hub and having a medium reception portion thereon for transferring and inserting at least one medium to a location between a first and second portion of container material.

20 Claims, 2 Drawing Sheets

AUTOMATED CONTAINER INSERT DEVICE

BACKGROUND OF THE INVENTION

1. Technical Field

The present disclosure relates to the manufacture of containers, and more particularly to the manufacture of containers having a medium inserted therein during the manufacturing process.

2. Description of the Related Art

Many versions of container manufacturing apparatus are known in the art. For example, U.S. Pat. Nos. 4,923,436 and 2,943,167 to Gelbard disclose methods and apparatus for manufacturing plastic bags with handles and pleated side portions, and U.S. Pat. No. 3,534,666 to Maccherone discloses a method and apparatus for making plastic bags having pleated bottom ends capable of squaring up when the bags are filled.

There is often a need not only to manufacture a container (e.g., a bag), but to insert an item into the container during the manufacturing process. For example, U.S. Pat. No. 2,524,846 to Socke et al. discloses a bag filling or packing machine wherein bags or other containers are filled with cans in an assembly line fashion.

However, in conventional methods and apparatus, a bag or container is typically manufactured as a first step and then an additional step is required to insert the intended item into the completed container. In some instances, this step becomes very complex. For example, an additional step may be required to open the newly formed container by mechanical, pneumatic or other means, such that the insert item may be placed therein. The required additional steps prolong the overall process and increase the costs associated therewith.

Thus a need exists for a method and apparatus for inserting a medium into a container in line, during the manufacturing process without interrupting the overall process.

SUMMARY OF THE INVENTION

It is an object of the present disclosure to provide a turret assembly for use in a container manufacturing apparatus which comprises a rotatable hub, and at least one arm extending radially from the rotatable hub and having a medium reception portion thereon for transferring and inserting at least one medium to a location between a first and second portion of container material.

It is another object of the present disclosure to provide a method of inserting a medium into a container during the container manufacturing process comprising the steps of supplying at least a first and second portion of material for forming the container, inserting at least one insert medium between the first and second portion of material, and sealing at least one side of the first and second portion of material having at least one insert medium therebetween.

It is yet another object of the present disclosure to provide an apparatus for fabricating a container including a first station for supplying a first and second portion of material for forming the container, and a second station for sealing at least one side of the first and second portion of material, wherein the improvement comprises a third station for in line insertion of at least one medium between the first and second portion of material during manufacture of the container.

These and other objects, features and advantages of the present disclosure will become apparent from the following detailed description of illustrative embodiments, which is to be read in connection with the accompanying drawings.

BRIEF DESCRIPTION OF THE DRAWINGS

For a better understanding of the invention, reference is made to the following description of exemplary embodiments thereof, and to the accompanying drawings, wherein.

DETAILED DESCRIPTION OF A PREFERRED EMBODIMENT

Figure 1:
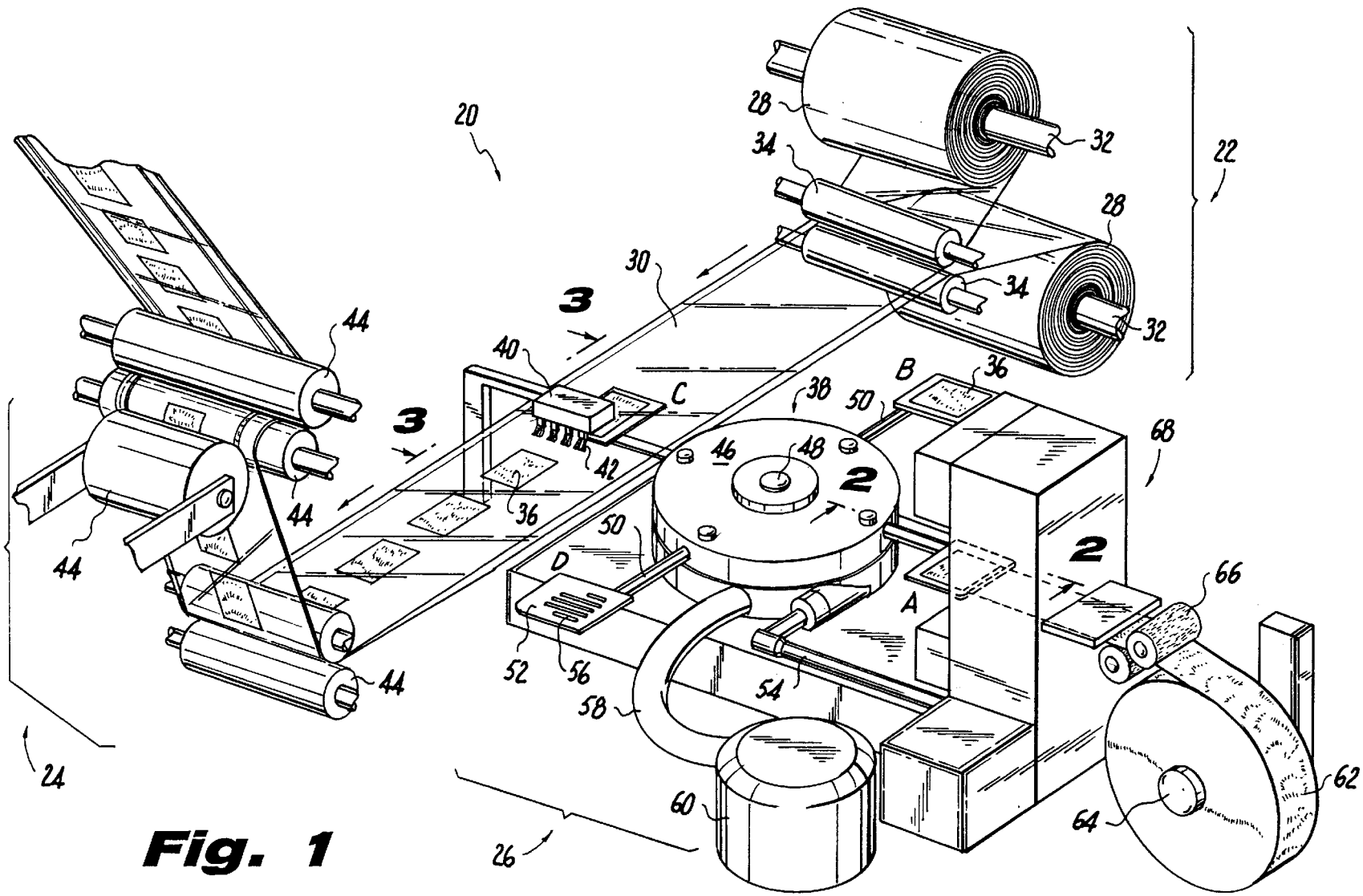
FIG. 1 is a perspective view of a container manufacturing apparatus incorporating an automated container insert device in accordance with the present disclosure.

Referring initially to FIG. 1, a perspective view of a container manufacturing apparatus 20 is illustrated. The presently disclosed container manufacturing apparatus 20 is advantageously configured to permit the continuous manufacture of containers wherein a medium is inserted into the containers during the manufacturing process prior to sealing all of the edges of the containers. As illustrated in FIG. 1, container manufacturing apparatus 20 comprises three significant stations in the overall manufacturing process; i.e., container web supplying station 22, container web receiving station 24 and medium inserting station 26.

The container web supplying station includes two rolls 28 of web material 30 supported on shafts 32 which allow rolls 28 to rotatably dispense web material 30 as required. Web material 30 is routed through a plurality of rollers 34 which provides the necessary guidance, direction and tension to the web material 30 as it leaves rolls 28.

As web material 30 leaves rollers 34, it moves in the direction of medium inserting station 26, where a medium 36 is inserted in a gap formed between the two layers of web material 30. As will be discussed in greater detail below, medium 36 is inserted between the layers of web material by turret assembly 38. A brush assembly 40 is positioned adjacent a location where medium 36 is inserted between web material 30 such that a plurality of brushes 42 extending from brush assembly 40 toward web material 30 urgingly bias the upper layer of web material 30 towards the bottom layer thereby narrowing the gap therebetween and effectively encasing medium 36 at predetermined locations along the length of web material 30. The effect of brushes 42 will be discussed in further detail below, with reference to FIGS. 3 and 4.

Web material 30 then proceeds in the direction of web receiving station 24 at which point a plurality of rollers 44 guide the material to a subsequent stage in the container manufacturing process. For example, the web may be guided toward a heat sealing knife unit (not shown) to selectively sever the web at locations between successive units of insert medium 36, thereby forming a stream of individual containers having inserts therein which may then proceed to a transfer unit. Heat sealing knife units and transfer units are well known to one having ordinary skill in the art.

Turret assembly 38 is advantageously provided to continuously insert a medium 36 in a stream of web material 30 in a container manufacturing apparatus and process, without interrupting the continuity thereof. Turret assembly 38 comprises a substantially cylindrical hub 46 which is configured to rotate about a central axis 48, and is caused to rotate in a counter-clockwise direction, as viewed from the top, by pneumatic means through pneumatic piping 54 or by any other means known to one having ordinary skill in the art (e.g., an electric motor). Four arms positioned substantially orthogonal to each other formed of tubular members, extend radially from cylindrical hub 46 and include a medium reception paddle portion 52 on a distal end thereof. Paddle portions 52 are advantageously configured to have a plurality of slots 56 in an upper surface thereof which are in communication, through tubular arms 50 and piping 58, with a source of vacuum (e.g., vacuum pump 60) to firmly secure insert medium 36 at the surface of paddle portions 52. Although it is preferable to have four arms 50, as illustrated, turret assembly 38 may comprise one or more arms 50.

Figure 2:
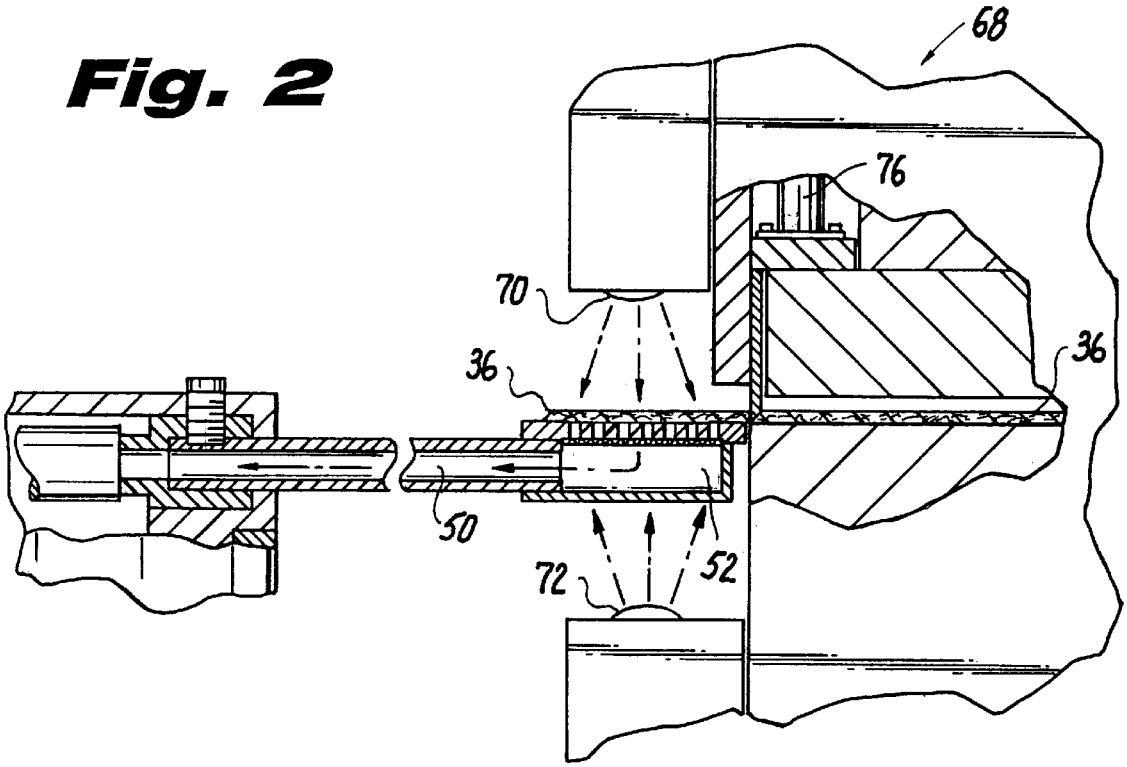
FIG. 2 is a side view of a section of the automated container insert device wherein the insert medium is picked up for transfer to the container location.

A roll 62 provides a continuous supply of medium 36 which is cut to a predetermined length for transfer and insertion between web material 30. Roll 62 is rotatably mounted about its central axis 64 such that medium 36 is fed off the top of roll 62 into a plurality of rollers 66 and into cutter assembly 68. A partial cross-sectional side view of cutter assembly 68 is illustrated in FIG. 2. Insert medium 36 enters cutter assembly 68 from the right side of FIG. 2 and moves to the left to a location where its presence is detected by optical eyes 70 and 72. When a predetermined length of medium 36 is detected, cutting blade 74 is forced downward by piston 76 to cut medium 36. Piston 76 is preferably controlled by a pneumatic control system which receives a signal from optical eyes 70 and 72. It is also contemplated that a stack of precut insert media may be used.

Referring now to FIGS. 1 and 2, the operation of turret assembly 38 will be described. As turret assembly 38 rotates in a counter-clockwise direction, as described above, each of the four radially extending arms 50 and paddles 52 is alternately rotated through one of four locations A, B, C and D. Beginning with location A, paddle 52 is positioned to receive insert medium 36. When paddle 52 is correctly aligned at location A, it will be detected by optical eyes 70 and 72. Optical eyes 70 and 72 are designed to send the appropriate control signal to (i) feed a predetermined length of medium 36 to the upper surface of paddle 52, and (ii) to initiate a vacuum within shaft 50, which is communicated with slots 56 in paddle 52, to secure medium 36 thereon. Paddle 52 is then rotated 900 to location B at which it holds medium 36 and awaits rotation to location C. While at location B, the other paddles 52 perform the designated functions at locations A, C and D. Paddle 52 is again rotated 90° to location C wherein paddle 52 is interposed the two webs of container web material 30. While at location C, another paddle 52 will be positioned at location A. As discussed above, as a paddle 52 enters location A, its presence will be detected by optical eyes 70 and 72, and a vacuum force will be applied. At the same time, taking advantage of the fact that locations A and C are 180° away from each other, the vacuum force on the paddle situated at location C will be removed. Therefore, while at location C, insert medium 36 will no longer be secured to paddle 52 and, as will be discussed in more detail with reference to FIGS. 3 and 4, medium 36 will be swept off paddle 52 by web 30. Finally, paddle 52 is rotated 90° to location D where it is ready to begin another cycle.

Figure 3:
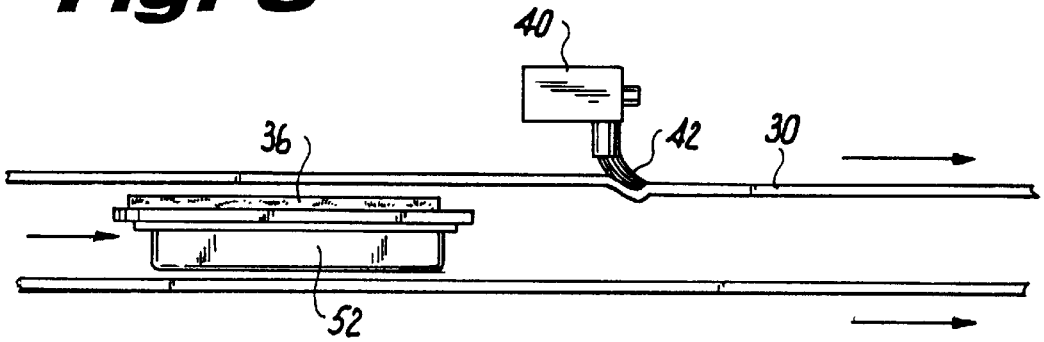
FIG. 3 is a side view of an arm of a turret delivering an insert to a gap formed between two webs of container material.
Figure 4:
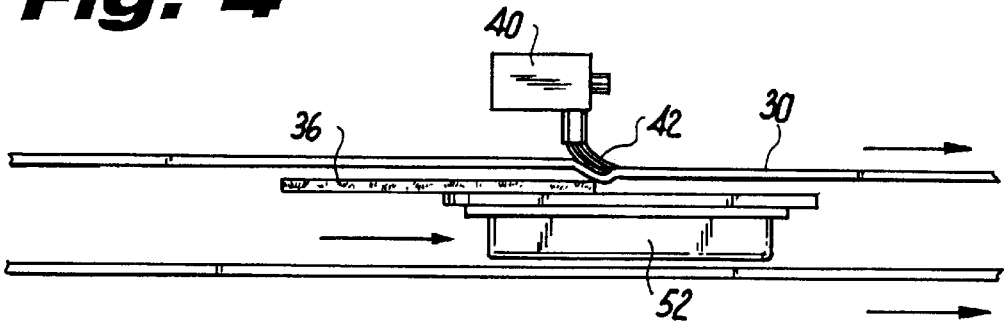
FIG. 4 is a side view of an arm of the turret delivering an insert to a gap formed between two webs of container material at a period of time subsequent to that shown in FIG. 3.

Referring now to FIGS. 3 and 4, a detail view of the transfer of medium 36 from paddle 52 to web 30 is illustrated. Beginning with FIG. 3, paddle 52, carrying insert medium 36, enters the gap between the two layers of web material 30. As they enter, both the paddle 52 and insert medium 36 are unobstructed by the flow of web material 30. However, as they proceed in the direction of the arrows toward the right side of FIGS. 3 and 4, the plurality of brushes 42 extending from brush assembly 40 bias the upper layer of web material 30 in a direction to decrease the width of the gap between the layers of web material 30. Thus, as shown in FIG. 4, as paddle 52 moves past brush assembly 40, insert medium 36 is swept off paddle 52 and thereafter becomes entrained in the stream of flow of the layers of web material 30. Also, as discussed above, to facilitate the separation of insert medium 36 from paddle 52, the control system is designed to release the vacuum force applied at the upper surface of paddle 52 precisely at the point in time at which paddle 52 passes brush assembly 40. The two layers of web material 30, carrying the plurality of insert medium 36 will then proceed toward the final stage of the manufacturing process wherein individual containers will be formed, each containing an insert medium.

The device of the present disclosure is expected to find application in the manufacture of plastic bags having a medium therein. In particular, in the medical industry, plastic bags are commonly used to discard waste material. Such waste material may comprise vials of liquids, such as, for example, blood or urine. During the handling of the plastic bags it is not uncommon for a vial to break and a bag to tear, thereby having a potential to leak the liquids contained therein. Thus, in a preferred application of the present disclosure, plastic bags may be formed from web material 30, wherein the insert medium is a layer of absorbent material which will absorb any liquid within the bag, thereby preventing a leak in the event that the vial is broken and the bag is torn. However, the present disclosure is equally applicable to other types of containers and other types of insert medium, such as, for example, advertising, brochures, etc.

Although the illustrative embodiments of the present invention have been described herein with reference to the accompanying drawings, it is to be understood that the invention is not limited to those precise embodiments, and that various other changes and modifications may be affected therein by one skilled in the art without departing from the scope or spirit of the invention. All such changes and modifications are intended to be included within the scope of the invention as defined by the appended claims.

What is claimed is:

1. A turret assembly for use in a container manufacturing apparatus which comprises:

a rotatable hub;

a web of an insertion medium;

detecting means for detecting a predetermined length of insertion medium from said web;

cutting means for cutting said predetermined length of insertion medium;

at least one arm extending radially from said rotatable hub and having a medium reception portion thereon for receiving, transferring and inserting said predetermined length of insertion medium to a location between a first and second individual web of container material;

vacuum means for selectively holding said predetermined length of insertion medium on said medium reception portion; and means for biasing said first web of material in a direction toward said second web of material adjacent said location wherein said predetermined length of insertion medium is inserted whereby said vacuum means for selectively retaining said predetermined length of insertion medium on said medium reception portion is removed from said medium reception portion.

2. A turret assembly for use in a container manufacturing apparatus as recited in claim 1, wherein said at least one arm is formed of a tubular member.

3. A turret assembly for use in a container manufacturing apparatus as recited in claim 1, wherein said medium reception portion is a paddle member connected adjacent a distal end of said at least one arm.

4. A turret assembly for use in a container manufacturing apparatus as recited in claim 1, wherein said medium reception portion includes a plurality of slots in an upper surface thereof.

5. A turret assembly for use in a container manufacturing apparatus as recited in claim 4, wherein said plurality of slots in said upper surface of said medium reception portion are operatively connected through said at least one arm to said vacuum means, for selectively holding said predetermined length of insertion medium on said medium reception portion.

6. A turret assembly for use in a container manufacturing apparatus as recited in claim 1, which comprises four arms extending radially from said rotatable hub.

7. A turret assembly for use in a container manufacturing apparatus as recited in claim 6, wherein said four arms are positioned substantially orthogonal to each other.

8. The turret assembly for use in a container manufacturing apparatus as recited in claim 1, wherein said means for biasing said first web material in a direction toward said second web of material adjacent said location wherein said predetermined size of insertion medium is inserted is a brush assembly.

9. A method of inserting a medium into a container during the container manufacturing process comprising the steps of:

continuously supplying at least a first and second individual web of material for forming said container;

continuously detecting and cutting a predetermined size of insert medium which is supplied from a web of insert medium;

continuously transferring and inserting said predetermined size of insert medium between said first and second individual web of material via a turret assembly;

retaining said predetermined size of insert medium on a medium reception portion of said turret assembly via a source of vacuum during said transfer and insertion step;

biasing said first web of material in a direction toward said second web of material to at least partially decrease a size of a gap formed between said first and second individual webs of material to assist in the step of continuously inserting said at least one insert medium between said first and second webs of material;

releasing the source of vacuum for retaining said predetermined size of insert medium on the medium reception portion of said turret assembly, after said biasing step; and forwarding said first and second individual webs of material having said at least one insert medium therebetween to a sealing apparatus for sealing at least one side of said first and second individual webs of material to at least partially form a container having said at least one insert medium therein.

10. A method of inserting a medium into a container during the container manufacturing process as recited in claim 8, wherein said inserting step is performed prior to said sealing step.

11. The method of inserting a medium into a container during the container manufacturing process as recited in claim 9, further comprising the step of:

receiving said predetermined size of insert medium on a medium reception portion of a turret assembly prior to the inserting step.

12. The method of inserting a medium into a container during the container manufacturing process as recited in claim 9, further comprising the step of:

optically detecting the presence of an insert medium at a severing station prior to severing a predetermined size of insert medium from a continuous roll.

13. An apparatus for fabricating a container which comprises:

a first station for supplying a first and second individual web of material for forming said container;

means for conveying said first and second individual webs of material to a second station for at least partially sealing said first and second individual web of material;

a third station including a web of insertion medium and means for detecting and cutting a predetermined size of insertion medium from said web;

a fourth station including a turret assembly for continuously receiving transferring and inserting said predetermined size of insertion medium between said first and second individual web of material during fabrication of the container wherein said turret assembly includes vacuum means to selectively hold said predetermined size of insertion medium; and means for biasing said first web of material in a direction toward said second web of material adjacent a location wherein said predetermined size of insertion medium is inserted between said first and second individual webs.

14. An apparatus for fabricating a container as recited in claim 13, wherein said fourth station for inserting said predetermined size of medium between said first and second individual webs of material is interposed said first station for supplying said first and second individual webs of material and said second station for at least partially sealing said first and second individual webs of material.

15. An apparatus for fabricating a container as recited in claim 13, wherein said first station for supplying a first and second individual webs of material for forming said container comprises at least one roller assembly.

16. An apparatus for fabricating a container as recited in claim 13, wherein said first and second individual webs of material are continuous webs of material.

17. An apparatus for fabricating a container as recited in claim 13, wherein said turret assembly includes at least one radially extending arm to transfer said predetermined size of insertion medium to a gap formed between said first and second individual webs of material.

18. An apparatus for fabricating a container as recited in claim 17, wherein said predetermined size of insertion medium is held adjacent a distal end of said at least one radially extending arm by said vacuum means.

19. An apparatus for fabricating a container as recited in claim 13, wherein said container is a plastic bag.

20. An apparatus for fabricating a container as recited in claim 13, wherein said predetermined size of insertion medium is an absorbent material.

* * * * *